US010624418B2

(12) United States Patent
Mokos et al.

(10) Patent No.: US 10,624,418 B2
(45) Date of Patent: Apr. 21, 2020

(54) SHOE HAVING FEATURES FOR INCREASED FLEXIBILITY

(71) Applicant: Cole Haan LLC, New York, NY (US)

(72) Inventors: Jeffrey Mokos, Greenland, NH (US); Scott Patt, Greenland, NH (US)

(73) Assignee: COLE HAAN LLC, New York, NY (US)

( * ) Notice: Subject to any disclaimer, the term of this patent is extended or adjusted under 35 U.S.C. 154(b) by 567 days.

(21) Appl. No.: 15/005,113

(22) Filed: Jan. 25, 2016

(65) Prior Publication Data

US 2017/0208897 A1 Jul. 27, 2017

(51) Int. Cl.

| | |
|---|---|
| ***A43B 13/14*** | (2006.01) |
| ***A43B 3/00*** | (2006.01) |
| ***A43B 15/00*** | (2006.01) |
| ***A43B 23/02*** | (2006.01) |
| ***A43B 9/04*** | (2006.01) |
| ***A43B 13/22*** | (2006.01) |
| ***A43B 23/04*** | (2006.01) |
| ***A43B 7/08*** | (2006.01) |

(52) U.S. Cl.

CPC ..... *A43B 13/141* (2013.01); *A43B 3/0036* (2013.01); *A43B 7/085* (2013.01); *A43B 9/04* (2013.01); *A43B 13/223* (2013.01); *A43B 13/226* (2013.01); *A43B 15/00* (2013.01); *A43B 23/021* (2013.01); *A43B 23/027* (2013.01); *A43B 23/0235* (2013.01); *A43B 23/0245* (2013.01); *A43B 23/042* (2013.01)

(58) Field of Classification Search

CPC ..... A43B 13/141; A43B 7/085

USPC ..... 36/102, 43

See application file for complete search history.

(56) References Cited

U.S. PATENT DOCUMENTS

| | | | | |
|---|---|---|---|---|
| 211,629 | A | 1/1879 | Haskins | |
| 379,452 | A * | 3/1888 | Dalsheimer | 36/43 |
| 1,247,467 | A | 11/1917 | Strauss | |
| 1,695,225 | A | 12/1928 | Bohr | |
| 1,724,450 | A | 8/1929 | Callahan | |
| D90,235 | S | 7/1933 | Daniels | |
| 1,958,135 | A | 5/1934 | Dunbar | |
| D113,057 | S | 1/1939 | Calderazzo | |
| 2,398,623 | A | 4/1946 | Daniels | |
| 2,457,944 | A | 1/1949 | Vlastos | |
| 2,934,838 | A | 5/1960 | Ferriera | |
| 4,237,627 | A | 12/1980 | Turner | |
| 6,557,274 | B2 | 5/2003 | Litchfield et al. | |

(Continued)

FOREIGN PATENT DOCUMENTS

WO 2014/134024 A1 9/2014

OTHER PUBLICATIONS

Palmer, "Review—Cole Haan—ZeroGrand", The Gentleman's Standard, N.p., Aug. 31, 2014, Web.<https://gentlemenstandard.com/2014/07/10/review-cole-haan-zerogrand/>.

(Continued)

*Primary Examiner* — Alissa J Tompkins
*Assistant Examiner* — Catherine M Ferreira
(74) *Attorney, Agent, or Firm* — Thompson Coburn LLP

(57) ABSTRACT

A shoe includes a sole, an upper, and a welt. The sole and upper define a seam. The welt overlies the seam. The sole includes flex grooves. The upper includes perforations. The welt includes flex slits.

28 Claims, 9 Drawing Sheets

(56) References Cited

U.S. PATENT DOCUMENTS

| | | | | |
|---|---|---|---|---|
| 6,990,755 | B2 * | 1/2006 | Hatfield | A43B 3/0057 36/102 |
| 7,065,820 | B2 | 6/2006 | Meschter | |
| D578,294 | S | 10/2008 | Mervar et al. | |
| 7,832,123 | B2 | 11/2010 | Fallon et al. | |
| 8,321,984 | B2 | 12/2012 | Dojan et al. | |
| 8,789,295 | B2 | 7/2014 | Burch et al. | |
| 8,950,088 | B2 | 2/2015 | Aveni et al. | |
| 8,959,799 | B2 | 2/2015 | Nishiwaki et al. | |
| 2003/0033730 | A1 * | 2/2003 | Burke | A43B 7/142 36/25 R |
| 2005/0160622 | A1 | 7/2005 | Chen | |
| 2007/0245595 | A1 | 10/2007 | Chen et al. | |
| 2007/0266598 | A1 * | 11/2007 | Pawlus | A43B 13/141 36/102 |
| 2008/0127519 | A1 * | 6/2008 | Byrne | A43B 7/06 36/102 |
| 2009/0193683 | A1 * | 8/2009 | Igdari | A43B 7/142 36/91 |
| 2012/0079745 | A1 * | 4/2012 | Shalom | A43B 3/108 36/102 |
| 2013/0074370 | A1 * | 3/2013 | Park | A43B 5/008 36/102 |
| 2013/0219747 | A1 | 8/2013 | Lederer | |
| 2014/0237858 | A1 | 8/2014 | Adami et al. | |
| 2014/0283411 | A1 | 9/2014 | Nabernik et al. | |
| 2014/0366400 | A1 | 12/2014 | Henderson et al. | |

OTHER PUBLICATIONS

Stan, "Shoe Review: Inov 8 Bare-X 180", 9run—A Blog on Running and the Active Lifestyle, N.p., Apr. 3, 2012, Web. <http://www.9run.ca/2012_04_01_archive.html>.

"Steve Madden Ranney Wingtip Sneaker", www.dsw.com. DSW Inc., Oct. 25, 2014, Web.<http://www.dsw.com/shoe/steve+madden+ranney+wingtip+snearer?prodId=315009>.

Weber, Would You Wear It? The Wholecut Oxford:, Dappered, LLC, Sep. 16, 2013, Web. <https://dappered.com/2013/09/would-you-wear-it-the-wholecut-oxford/>.

"Cole Haan's Men's Montgomery Wingtip Oxford", Amazon.com., Inc., retrieved Aug. 21, 2015, Web. <https://www.amazon.com/Cole-Haan-Montgomery-Wingtip-Oxford/dp/B00WBV1VS6>.

* cited by examiner

SHOE HAVING FEATURES FOR INCREASED FLEXIBILITY

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to shoes having features for increased flexibility.

SUMMARY OF THE INVENTION

One aspect of the invention is a shoe comprising a sole, an upper operatively secured to the sole, and a welt. The sole comprises a sole bottom surface, a sole lateral side surface, a sole medial side surface, a sole heel end surface, and a sole toe end surface. The sole bottom surface extends transversely from the sole lateral side surface to the sole medial side surface. The sole lateral side surface and the sole medial side surface extend upwardly from the sole bottom surface. The sole extends longitudinally from the sole heel end surface to the sole toe end surface. The sole includes a sole heel region, a sole midfoot region, a sole metatarsal region, a sole ball region, and a sole toe region. The sole heel region extends longitudinally from the sole heel end surface to the sole midfoot region. The sole midfoot region extends longitudinally from the sole heel region to the sole metatarsal region. The sole metatarsal region extends from the sole midfoot region to the sole ball region. The sole ball region extends longitudinally from the sole metatarsal region to the sole toe region. The sole toe region extends longitudinally from the sole ball region to the sole toe end surface. The sole ball region includes a sole medial ball region and a sole lateral ball region. The upper comprises an upper heel region, an upper lateral midfoot region, an upper medial midfoot region, an upper metatarsal region, an upper lateral ball region, an upper medial ball region, and an upper toe region. The upper metatarsal region includes an upper lateral metatarsal region and an upper medial metatarsal region. The upper has an upper lateral side region and an upper medial side region. The upper lateral side region includes the upper lateral midfoot region, the upper lateral metatarsal region and the upper lateral ball region. The upper medial side region includes the upper medial midfoot region, the upper medial metatarsal region and the upper medial ball region. The sole and upper collectively define a seam. The seam has a seam heel region, a seam lateral midfoot region, a seam lateral metatarsal region, a seam lateral ball region, a seam toe region, a seam medial ball region, a seam medial metatarsal region, and a seam medial midfoot region. The seam heel region extends from the seam medial midfoot region to the seam lateral midfoot region. The seam lateral midfoot region extends from the seam heel region to the seam lateral metatarsal region. The seam lateral metatarsal region extends from the seam midfoot region to the seam lateral ball region. The seam lateral ball region extends from the seam lateral metatarsal region to the seam toe region. The seam toe region extends from the seam lateral ball region to the seam medial ball region. The seam medial ball region extends from the seam toe region to the seam medial metatarsal region. The seam medial metatarsal region extends from the seam medial ball region to the seam medial midfoot region. The seam medial midfoot region extends from the seam medial metatarsal region to the seam heel region. The welt comprises at least one piece separate from the sole and separate from the upper. The welt is secured to at least one of the sole and the upper. The welt covers at least part of the seam lateral side region and at least part of the seam medial side region. The sole includes a first plurality of flex grooves in the sole bottom surface. The first plurality of flex grooves extend transversely from the sole medial side surface toward the lateral side surface. The welt includes a first plurality of welt slits. At least some of the welt slits of the first plurality of welt slits are adjacent at least some of the flex grooves of the first plurality of flex grooves.

Another aspect of the invention is a shoe comprising a sole, an upper operatively secured to the sole, and a welt. The sole comprises a sole bottom surface, a sole lateral side surface, a sole medial side surface, a sole heel end surface, and a sole toe end surface. The sole bottom surface extends transversely from the sole lateral side surface to the sole medial side surface. The sole lateral side surface and the sole medial side surface extend upwardly from the sole bottom surface. The sole extends longitudinally from the sole heel end surface to the sole toe end surface. The sole includes a sole heel region, a sole midfoot region, a sole metatarsal region, a sole ball region, and a sole toe region. The sole heel region extends longitudinally from the sole heel end surface to the sole midfoot region. The sole midfoot region extends longitudinally from the sole heel region to the sole metatarsal region. The sole metatarsal region extends from the sole midfoot region to the sole ball region. The sole ball region extends longitudinally from the sole metatarsal region to the sole toe region. The sole toe region extends longitudinally from the sole ball region to the sole toe end surface. The sole ball region includes a sole medial ball region and a sole lateral ball region. The upper comprises an upper heel region, an upper lateral midfoot region, an upper medial midfoot region, an upper metatarsal region, an upper lateral ball region, an upper medial ball region, and an upper toe region. The upper metatarsal region includes an upper lateral metatarsal region and an upper medial metatarsal region. The upper has an upper lateral side region and an upper medial side region. The upper lateral side region includes the upper lateral midfoot region, the upper lateral metatarsal region and the upper lateral ball region. The upper medial side region includes the upper medial midfoot region, the upper medial metatarsal region and the upper medial ball region. The sole and upper collectively define a seam. The seam has a seam heel region, a seam lateral midfoot region, a seam lateral metatarsal region, a seam lateral ball region, a seam toe region, a seam medial ball region, a seam medial metatarsal region, and a seam medial midfoot region. The seam heel region extends from the seam medial midfoot region to the seam lateral midfoot region. The seam lateral midfoot region extends from the seam heel region to the seam lateral metatarsal region. The seam lateral metatarsal region extends from the seam midfoot region to the seam lateral ball region. The seam lateral ball region extends from the seam lateral metatarsal region to the a seam toe region. The seam toe region extends from the seam lateral ball region to the seam medial ball region. The seam medial ball region extends from the seam toe region to the seam medial metatarsal region. The seam medial metatarsal region extends from the seam medial ball region to the seam medial midfoot region. The seam medial midfoot region extends from the seam medial metatarsal region to the seam heel region. The welt has a welt heel region, a welt lateral midfoot region, a welt lateral metatarsal region, a welt lateral ball region, a welt toe region, a welt medial ball region, a welt medial metatarsal region, and a welt medial midfoot region. The welt heel region extends from the welt medial midfoot region to the welt lateral midfoot region and covers the seam heel region. The welt lateral midfoot region extends from the welt heel region to the welt lateral metatarsal region and covers the seam lateral midfoot region. The welt lateral metatarsal region extends from the welt lateral midfoot region to the welt lateral ball region and covers the seam lateral metatarsal region. The welt lateral ball region extends from the welt lateral metatarsal region to the welt toe region and covers the seam lateral ball region. The welt toe region extends from the welt lateral ball region to the welt medial ball region and covers the seam toe region. The welt medial ball region extends from the welt toe region to the welt medial metatarsal region and covers the seam medial ball region. The welt medial metatarsal region extends from the welt medial ball region to the welt medial midfoot region and covers the seam medial metatarsal region. The welt medial midfoot region extends from the welt medial metatarsal region to the welt heel region and coves the seam medial midfoot region. The welt includes a welt top surface, a welt bottom surface, a first plurality of welt slits extending from the welt top surface toward the welt bottom surface, and a second plurality of welt slits extending from the welt top surface toward the welt bottom surface. At least some of the welt slits of the first plurality of welt slits are in the welt medial ball region. At least some of the welt slits of the second plurality of welt slits are in the welt lateral ball region.

Another aspect of the invention is a shoe comprising a sole and an upper operatively secured to the sole. The sole comprises a sole bottom surface, a sole lateral side surface, a sole medial side surface, a sole heel end surface, and a sole toe end surface. The sole bottom surface extends transversely from the sole lateral side surface to the sole medial side surface. The sole lateral side surface and the sole medial side surface extend upwardly from the sole bottom surface. The sole extends longitudinally from the sole heel end surface to the sole toe end surface. The sole includes a sole heel region, a sole midfoot region, a sole metatarsal region, a sole ball region, and a sole toe region. The sole heel region extends longitudinally from the sole heel end surface to the sole midfoot region. The sole midfoot region extends longitudinally from the sole heel region to the sole metatarsal region. The sole metatarsal region extends from the sole midfoot region to the sole ball region. The sole ball region extends longitudinally from the sole metatarsal region to the sole toe region. The sole toe region extends longitudinally from the sole ball region to the sole toe end surface. The sole ball region includes a sole medial ball region and a sole lateral ball region. The upper comprises an upper outer layer. The upper outer layer comprises an outer layer heel region, an outer layer lateral midfoot region, an outer layer medial midfoot region, an outer layer metatarsal region, an outer layer lateral ball region, an outer layer medial ball region, and an outer layer toe region. The outer layer metatarsal region includes an outer layer lateral metatarsal region and an outer layer medial metatarsal region. The outer layer has an outer layer lateral side region and an outer layer medial side region. The outer layer lateral side region includes the outer layer lateral midfoot region, the outer layer lateral metatarsal region, and the outer layer lateral ball region. The outer layer medial side region includes the outer layer medial midfoot region, the outer layer medial metatarsal region, and the outer layer medial ball region. The outer layer is of leather. The outer layer includes a plurality of through perforations. Each of the perforations of the plurality of perforations has a perforation length and a perforation width. The perforation width extends in a longitudinal direction of the shoe. The longitudinal direction of the shoe is a direction extending generally toward the sole heel end surface and away from the sole toe end surface. The perforation length extends in a direction substantially perpendicular to the longitudinal direction of the shoe. The perforation length is greater than the perforation width.

Further features and advantages of the present invention, as well as the operation of the invention, are described in detail below with reference to the accompanying drawings.

Figure 1:
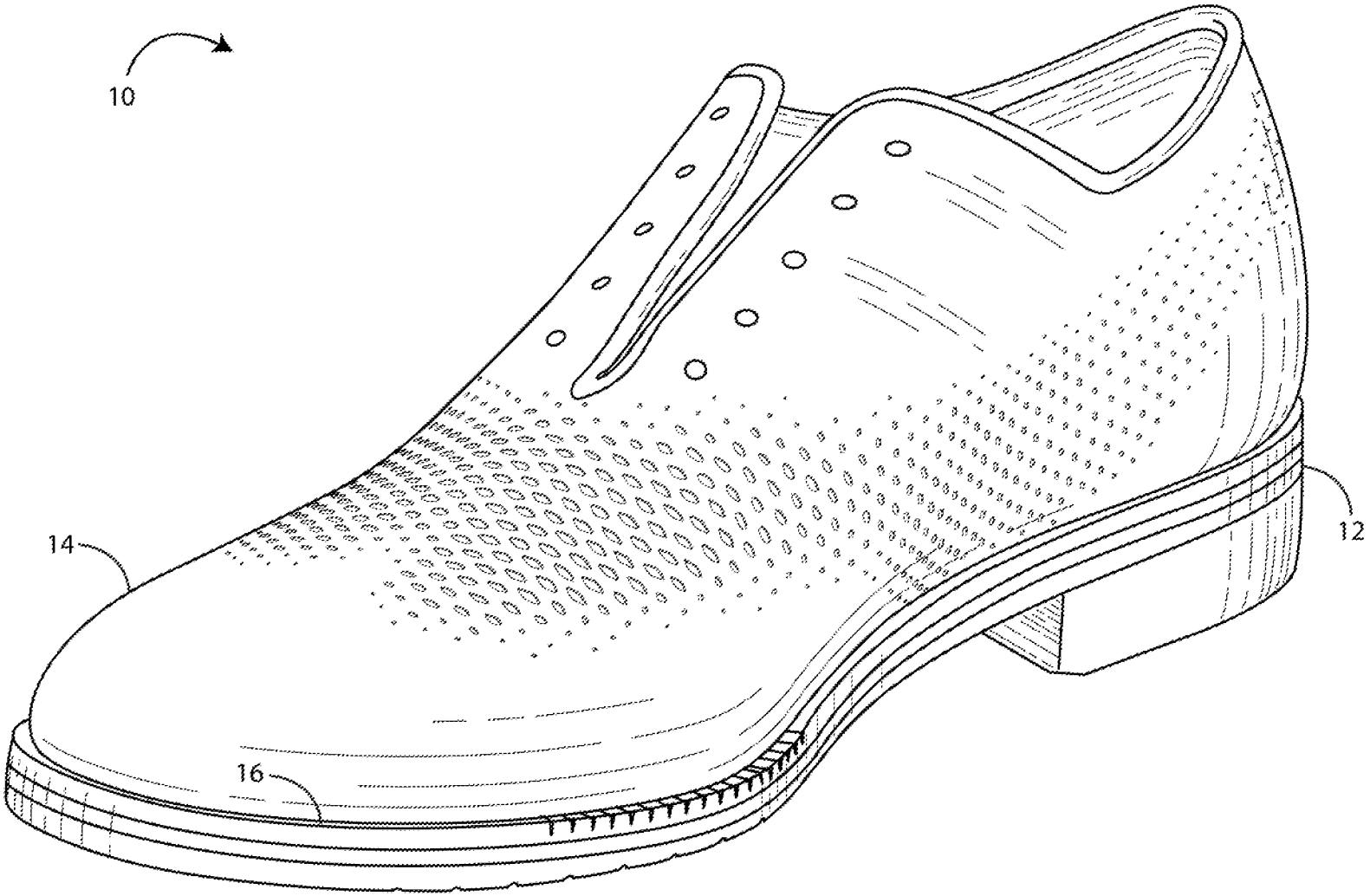
FIG. 1 is a perspective view of an embodiment of a shoe in accordance with the present invention, the shoe including a sole, an upper, and a welt.

Reference numerals in the written specification and in the drawing figures indicate corresponding items.

DETAILED DESCRIPTION

An embodiment of a shoe in accordance with the present invention is indicated by reference numeral 10 in FIGS. 1-7. The shoe 10 comprises a sole, generally indicated at 12, an upper, generally indicated at 14, and a welt, generally indicated at 16. The upper 14 is operatively secured to the sole 12.

The sole 12 comprises a lower sole member 18 and a heel member 20. The lower sole member 18 has a lower sole member bottom surface 22, a lower sole member lateral side surface 24, and a lower sole member medial side surface 26. The lower sole member bottom surface 22 extends transversely from the lower sole member lateral side surface 24 to the lower sole member medial side surface 26. The lower sole member lateral side surface 24 and the lower sole member medial side surface 26 extend upwardly from the lower sole member bottom surface 22. The heel member 20 has a heel member bottom surface 28, a heel member lateral side surface 30, and a heel member medial side surface 32. The heel member bottom surface 28 extends transversely from the heel member lateral side surface 30 to the heel member medial side surface 32. The heel member lateral side surface 30 and the heel member medial side surface 32 extend upwardly from the heel member bottom surface 28. Collectively, the lower sole member bottom surface 22 and the heel member bottom surface 28 constitute a sole bottom surface 34, the lower sole member lateral side surface 24 and the heel member lateral side surface 30 constitute a sole lateral side surface 36, and the lower sole member medial side surface 26 and the heel member medial side surface 32 constitute a sole medial side surface 38.

The sole 12 includes a sole heel end surface 40 and a sole toe end surface 42. The sole 12 extends longitudinally from the sole heel end surface 40 to the sole toe end surface 42. The sole 12 further includes a sole heel region 44, a sole midfoot region 46, a sole metatarsal region 48, a sole ball region 50, and a sole toe region 52. The sole heel region 44 extends longitudinally from the sole heel end surface 40 to the sole midfoot region 46. The sole midfoot region 46 extends longitudinally from the sole heel region 44 to the sole metatarsal region 48. The sole metatarsal region 48 extends from the sole midfoot region 46 to the sole ball region 50. The sole ball region 50 extends longitudinally from the sole metatarsal region 48 to the sole toe region 52. The sole toe region 52 extends longitudinally from the sole ball region 50 to the sole toe end surface 42. The sole ball region 50 includes a sole medial ball region 54 and a sole lateral ball region 56. The lower sole member 18 of this embodiment may be of leather or some other suitable material such as thermoplastic polyurethane. The heel member 20 of this embodiment may be of thermoplastic polyurethane or some other suitable material. In this embodiment the heel member 20 is a piece separate from the lower sole member 18. In another embodiment, the heel member and lower sole member together are a single unitary piece.

Figure 7:
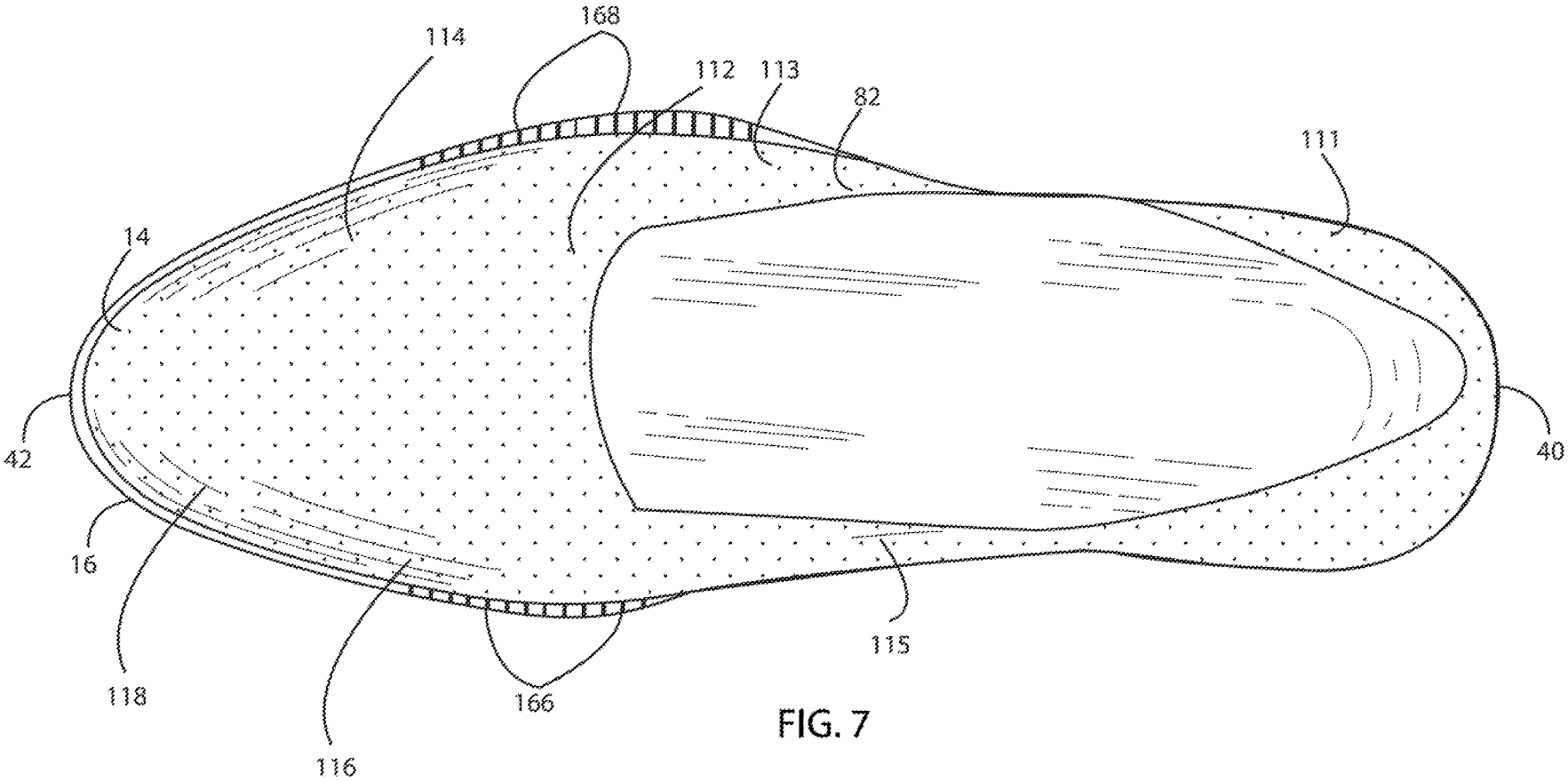
FIG. 7 is a top plan view the same as FIG. 5 without the outer layer to reveal an inner layer of the upper.

The upper 14 comprises an upper heel region 58, an upper lateral midfoot region 60, an upper medial midfoot region 62, an upper metatarsal region 64, an upper lateral ball region 66, an upper medial ball region 68, and an upper toe region 70. The upper metatarsal region 64 includes an upper lateral metatarsal region 72 and an upper medial metatarsal region 74. The upper 14 has an upper lateral side region 76 and an upper medial side region 78. The upper lateral side region 76 includes the upper lateral midfoot region 60, the upper lateral metatarsal region 72 and the upper lateral ball region 66. The upper medial side region 78 includes the upper medial midfoot region 62, the upper medial metatarsal region 74 and the upper medial ball region 68. The upper 14 comprises an upper outer layer 80 (FIG. 5) and an upper inner layer 82 (FIG. 7).

The upper outer layer 80 comprises an outer layer heel region 84, an outer layer lateral midfoot region 86, an outer layer medial midfoot region 88, an outer layer metatarsal region 90, an outer layer lateral ball region 92, an outer layer medial ball region 94, and an outer layer toe region 96. The outer layer metatarsal region 90 includes an outer layer lateral metatarsal region 98 and an outer layer medial metatarsal region 100. The upper outer layer 80 has an outer layer lateral side region 102 and an outer layer medial side region 104. The outer layer lateral side region 102 includes the outer layer lateral midfoot region 86, the outer layer metatarsal region 90, and the outer layer lateral ball region 92. The outer layer medial side region 104 includes the outer layer medial midfoot region 88, the outer layer medial metatarsal region 100, and the outer layer medial ball region 94. The upper outer layer 80 of this embodiment is of leather. But it is to be understood that the upper outer layer 80 could be of other materials.

Figure 6:
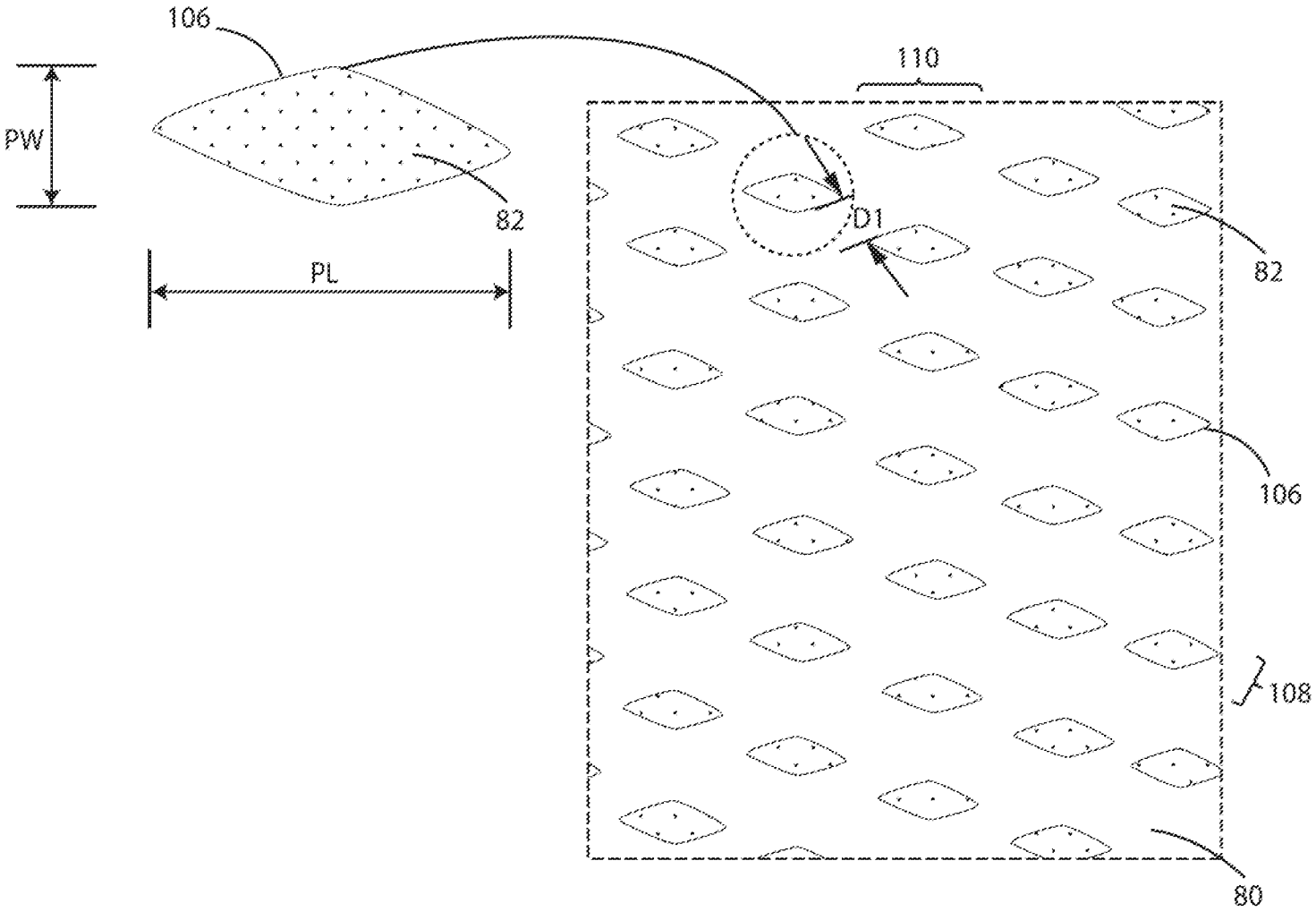
FIG. 6 is an enlarged view of the broken line box shown in FIG. 5.

The upper outer layer 80 includes a plurality of through-perforations 106. The perforations may be formed in the upper outer layer via a programmable laser or by other conventional cutting methods to form the perforations 106 in a precise pattern. Each of the perforations of the plurality of perforations 106 has a perforation length PL and a perforation width PW. The perforation width PW extends in a longitudinal direction of the shoe 10. The longitudinal direction of the shoe 10 is a direction extending generally toward the sole heel end surface 40 and away from the sole toe end surface 42. Because "longitudinal direction" as used herein is a reference to orientation instead of motion, it is to be understood that the longitudinal direction of the shoe 10 could alternatively be stated as a direction extending generally away from the sole heel end surface 40 and toward the sole toe end surface 42 without changing the meaning of the term. The perforation length PL extends in a direction substantially perpendicular to the longitudinal direction of the shoe 10. The perforation length PL is greater than the perforation width PW. In this embodiment, the perforation length PL is at least twice as great as the perforation width PW. Each one of the perforations of the plurality of perforations 106 is spaced a distance D1 from another one of the plurality of perforations. In the present embodiment, the distance D1 is less than twice the perforation length PL of said another one of the plurality of perforations and, is more specifically, less than the perforation length PL of said another one of the plurality of perforations. As best shown in FIG. 6, each perforation 106 is diamond-shaped. But in an alternative embodiment, the perforations may be of a different shape such as a rectangle or an oval. At least some of the plurality of perforations 106 are in the outer layer metatarsal region 90. The plurality of perforations 106 in the outer layer metatarsal region 90 comprises at least one hundred perforations, which means the outer layer metatarsal region 90 also necessarily comprises at least seventy-five perforations. The plurality of perforations 106 in the outer layer metatarsal region 90 are in a pattern comprising a plurality of rows 108 and a plurality of columns 110. In this embodiment, the plurality of rows 108 are generally parallel to one another and extend in a first diagonal direction, and the plurality of columns 110 are generally parallel to one another and extend in a second diagonal direction different from the first diagonal direction. It is to be understood that in another embodiment of the present invention, the plurality of rows could extend transversely in a direction perpendicular to the longitudinal direction of the shoe 10, and the plurality of columns could extend in the longitudinal direction of the shoe 10.

Figure 2:
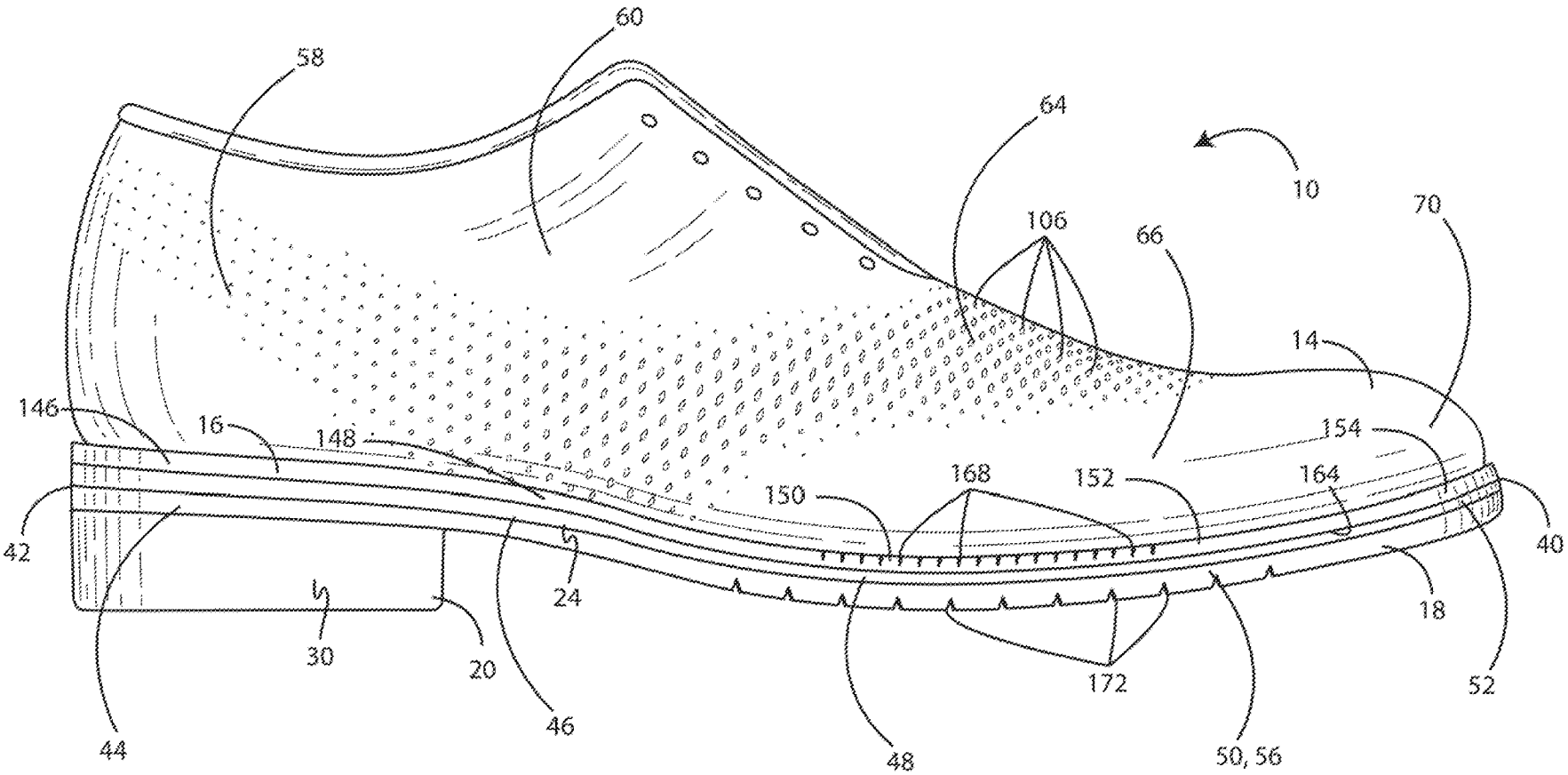
FIG. 2 is a lateral side elevational view of the shoe shown in FIG. 1.
Figure 3:
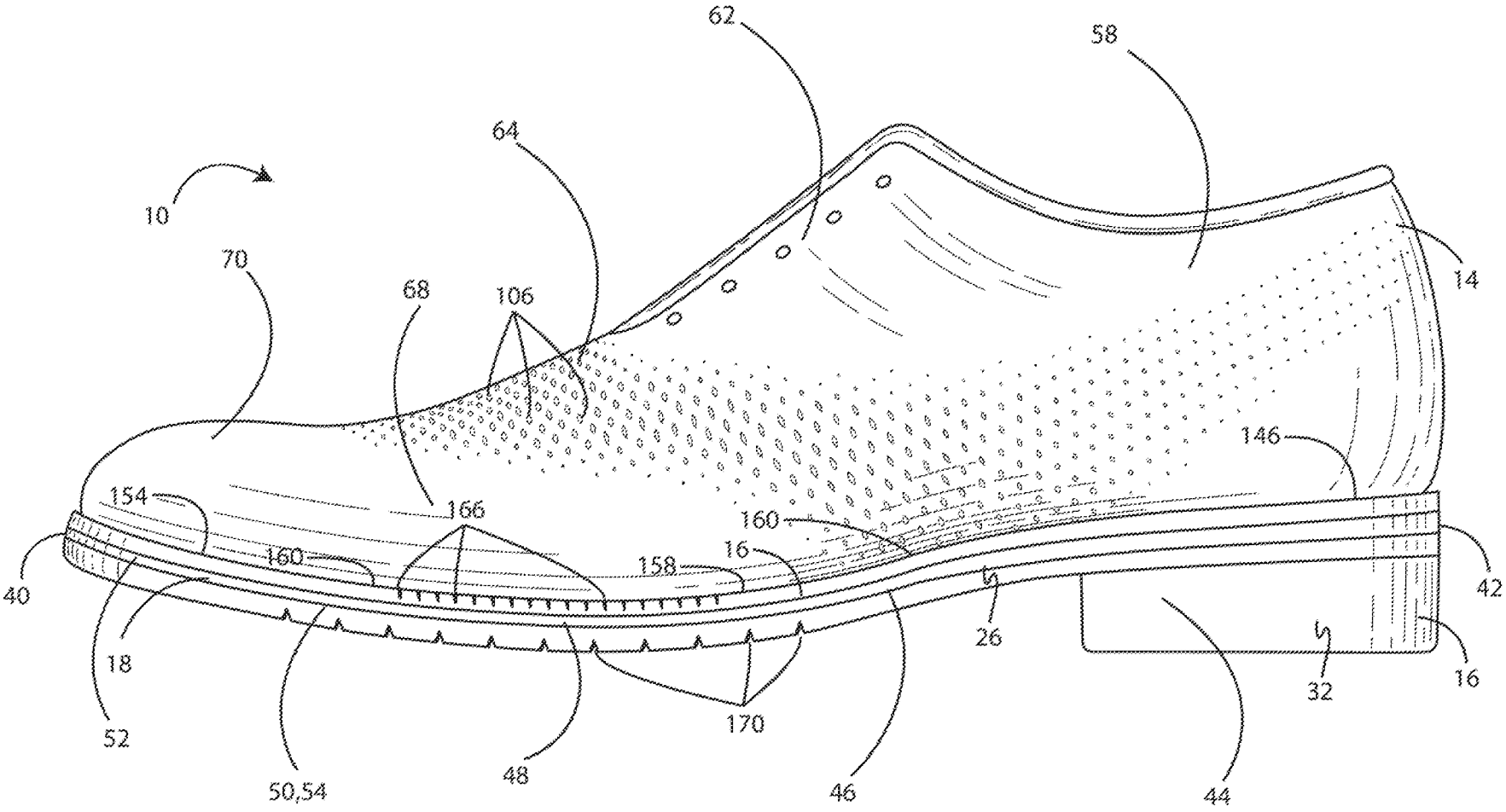
FIG. 3 is a medial side elevational view of the shoe shown in FIG. 1.

Although the shoe 10 includes a plurality of perforations meeting the characteristics described herein, it is to be understood that not all perforations in the shoe 10 necessarily meet the characteristics. For example, as evident in the drawing figures, the spacing between some of the adjacent perforations in the shoe 10 is much farther than described above concerning the plurality of perforations. It is also to be understood that the sizes of the perforations may vary throughout the shoe. As shown in FIGS. 2 and 3, the sizes (e.g. dimensions or areas) of the perforations generally decrease from the outer layer metatarsal region 90 to the outer layer heel region 84. In other words, the average (mean) size of the perforations in the outer layer metatarsal region 90 is greater than the average size of the perforations in the outer layer lateral and medial midfoot regions 86, 88, which is greater than the average size of the perforations in the outer layer heel region 84. As shown in FIGS. 2 and 3, although the spacing between adjacent perforations varies in the shoe 10 in this embodiment, the center-to-center spacing between adjacent perforations (i.e, the distance from the center of one perforation to the center of an adjacent perforation) is approximately the same throughout the shoe. Because of the different sizing and/or spacing of the perforations in the upper outer layer 80, the outer layer metatarsal and ball regions 90, 92, 94, are more flexible and more breathable than the outer layer lateral and medial midfoot regions 84, 86, which are more flexible and more breathable than the outer layer heel region 84 and the outer layer toe region 96.

As shown in FIG. 7, the upper inner layer 82 comprises an inner layer metatarsal region 112, an inner layer lateral ball region 114, an inner layer medial ball region 116, and an inner layer toe region 118. The inner layer metatarsal region 112 includes an inner layer lateral metatarsal region 120 and an inner layer medial metatarsal region 122. The upper inner layer 82 has an inner layer lateral side region 124 and an inner layer medial side region 126. The upper outer layer 80 overlies the upper inner layer 82 such that the upper inner layer 82 is visible through at least some of the plurality of perforations 106 of the upper outer layer. In one embodiment of the present invention, the upper inner layer 82 is unattached to the upper outer layer 80 adjacent at least some of the plurality of perforations 106 in the outer layer metatarsal region 90, enabling the upper inner layer to move independently of the upper outer layer at this location. The upper inner layer 82 may be of a textile material. In one embodiment of the present invention, the upper inner layer 82 is of a moisture wicking fabric. In conjunction with the perforations, the moisture wicking fabric can help provide breathability to the shoe 10. The moisture wicking fabric may comprise spandex. It is to be understood that the upper inner layer 82 could be of an alternative textile material.

Figure 2A:
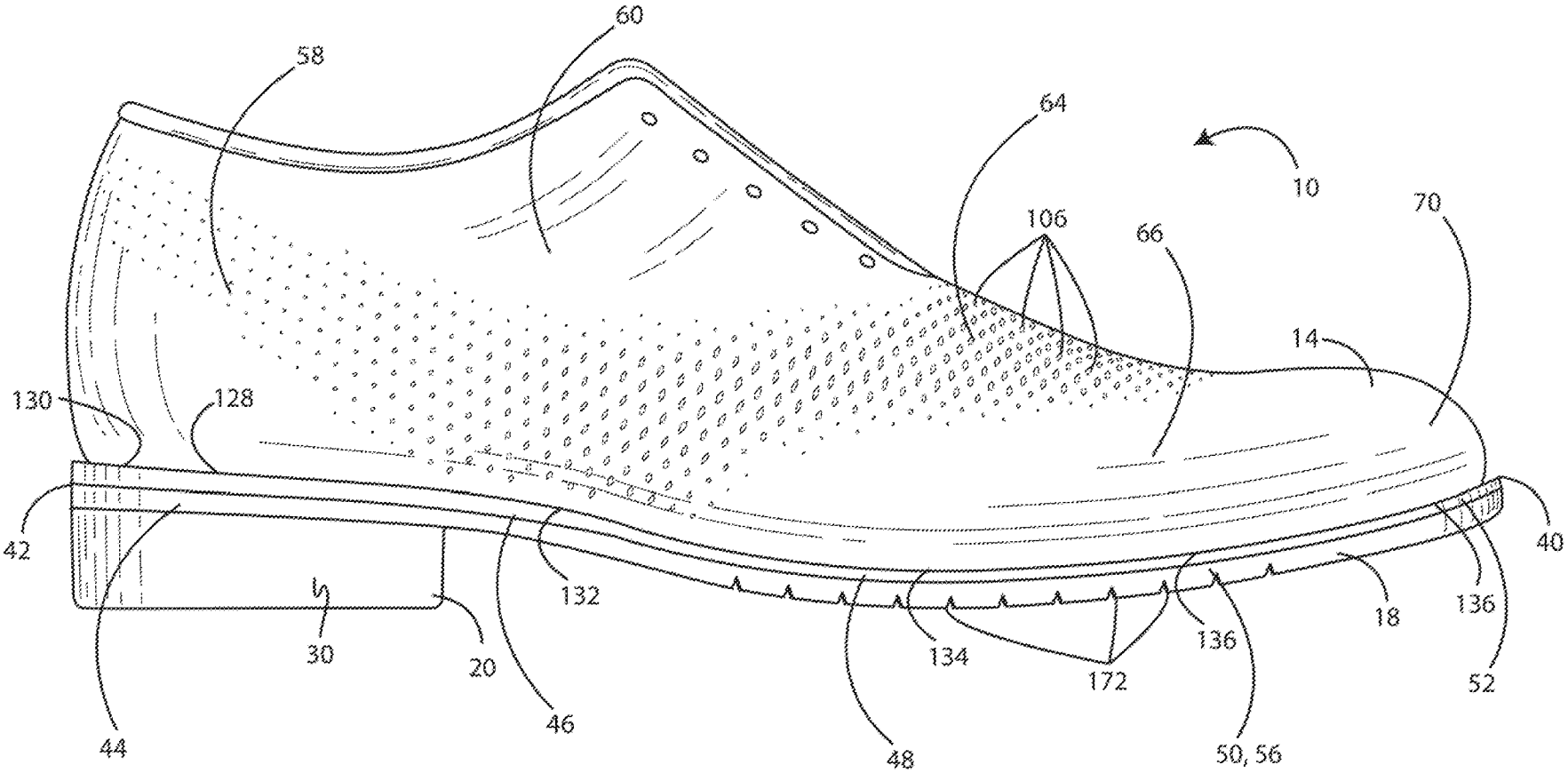
FIG. 2A is a lateral side elevational view the same as FIG. 2 without the welt.
Figure 3A:
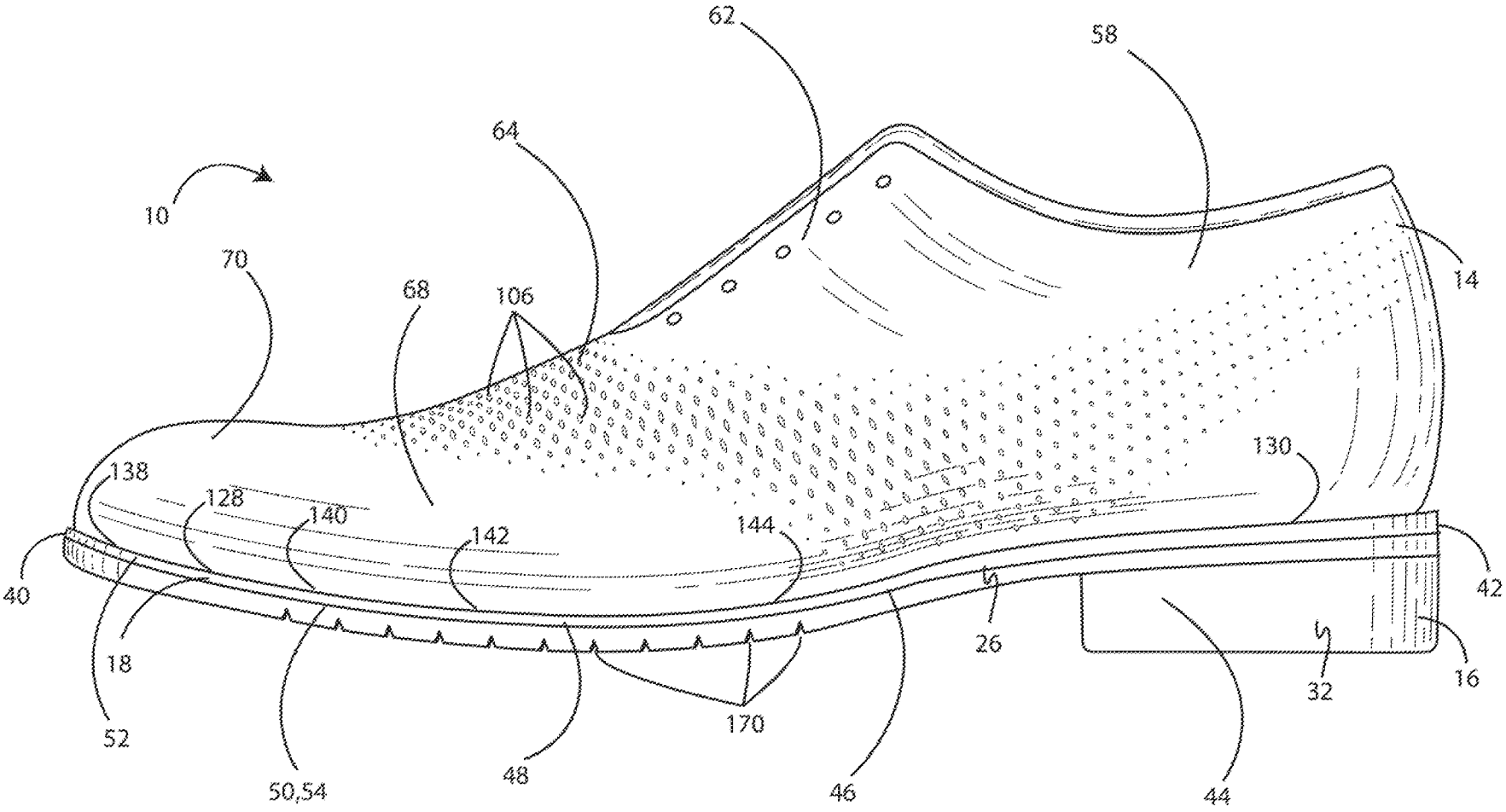
FIG. 3A is a medial side elevational view the same as FIG. 3 without the welt.

As shown in FIGS. 2A and 3A, the sole 12 and the upper 14 collectively define a seam 128. The seam 128 has a seam heel region 130, a seam lateral midfoot region 132, a seam lateral metatarsal region 134, a seam lateral ball region 136, a seam toe region 138, a seam medial ball region 140, a seam medial metatarsal region 142, and a seam medial midfoot region 144. Each of the seam regions is collectively defined by corresponding regions of the sole 12 and the upper 14. The seam heel region 130 extends from the seam medial midfoot region 144 to the seam lateral midfoot region 132. The seam lateral midfoot region 132 extends from the seam heel region 130 to the seam lateral metatarsal region 134. The seam lateral metatarsal region 134 extends from the seam lateral midfoot region 132 to the seam lateral ball region 136. The seam lateral ball region 136 extends from the seam lateral metatarsal region 134 to the seam toe region 138. The seam toe region 138 extends from the seam lateral ball region 136 to the seam medial ball region 140. The seam medial ball region 140 extends from the seam toe region 138 to the seam medial metatarsal region 142. The seam medial metatarsal region 142 extends from the seam medial ball region 140 to the seam medial midfoot region 144. The seam medial midfoot region 144 extends from the seam medial metatarsal region 142 to the seam heel region 130.

As shown in FIGS. 1, 2, 4 and 5, the welt 16 comprises at least one piece separate from the sole 12 and separate from the upper 14. The welt 16 constitutes a single, one-piece member secured to at least one of the sole 12 and the upper 14. The welt 16 has a welt heel region 146, a welt lateral midfoot region 148, a welt lateral metatarsal region 150, a welt lateral ball region 152, a welt toe region 154, a welt medial ball region 156, a welt medial metatarsal region 158, and a welt medial midfoot region 160. The welt heel region 146 extends from the welt medial midfoot region 160 to the welt lateral midfoot region 148 and covers the seam heel region 130. The welt lateral midfoot region 148 extends from the welt heel region 146 to the welt lateral metatarsal region 150 and covers the seam lateral midfoot region 132. The welt lateral metatarsal region 150 extends from the welt lateral midfoot region 148 to the welt lateral ball region 152 and covers the seam lateral metatarsal region 134. The welt lateral ball region 152 extends from the welt lateral metatarsal region 150 to the welt toe region 154 and covers the seam lateral ball region 136. The welt toe region 154 extends from the welt lateral ball region 152 to the welt medial ball region 156 and covers the seam toe region 138. The welt medial ball region 156 extends from the welt toe region 154 to the welt medial metatarsal region 158 and covers the seam medial ball region 140. The welt medial metatarsal region 158 extends from the welt medial ball region 156 to the welt medial midfoot region 160 and covers the seam medial metatarsal region 142. The welt medial midfoot region 160 extends from the welt medial metatarsal region 158 to the welt heel region 146 and covers the seam medial midfoot region 144.

The welt 16 is of leather and includes a welt top surface 162, a welt bottom surface 164, a first plurality of welt slits 166, and a second plurality of welt slits 168. It is to be understood that in some embodiments of the present invention, the welt could be of a material other than leather. The first and second pluralities of welt slits 166, 168 extend from the welt top surface 162 toward the welt bottom surface 164. The welt slits 166, 168 may be formed via a programmable laser or via some other conventional cutting process. At least some of the welt slits of the first plurality of welt slits 166 are in the welt medial ball region 156 and at some of the welt slits of the second plurality of welt slits 168 are in the welt lateral ball region 152. In this embodiment, the first plurality of welt slits 166 are only in the welt medial ball and metatarsal regions 156, 158, and the second plurality of welt slits 168 are only in the welt lateral ball and metatarsal regions 152, 150. The welt heel region 146, the welt lateral midfoot region 148, the welt medial midfoot region 160, and the welt toe region 154 are devoid of welt slits. In one embodiment of the present invention, the welt top surface 162 is devoid of stitches adjacent the first and second pluralities of welt slits 166, 168 In an alternative embodiment of the present invention, the welt top surface 162 is devoid of stitches in the welt heel region 146, the welt lateral midfoot region 148, the welt lateral metatarsal region 150, the welt lateral ball region 152, the welt toe region 154, the welt medial ball region 156, the welt medial metatarsal region 158, and the welt medial midfoot region 160. In yet another alternative embodiment of the present invention, the welt 16 is devoid of any visible stitching.

Figure 4:
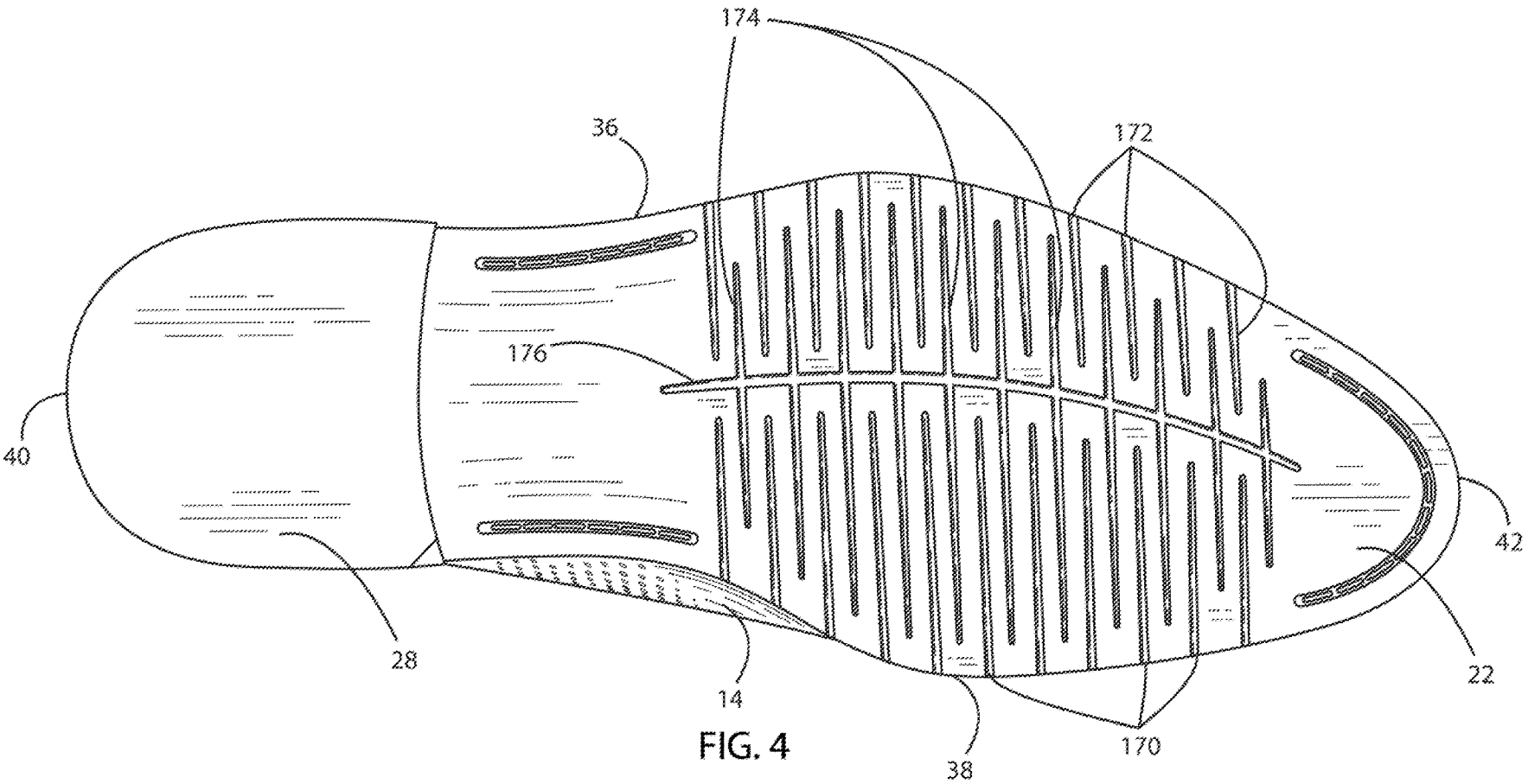
FIG. 4 is a bottom plan view of the shoe shown in FIG. 1.
Figure 5:
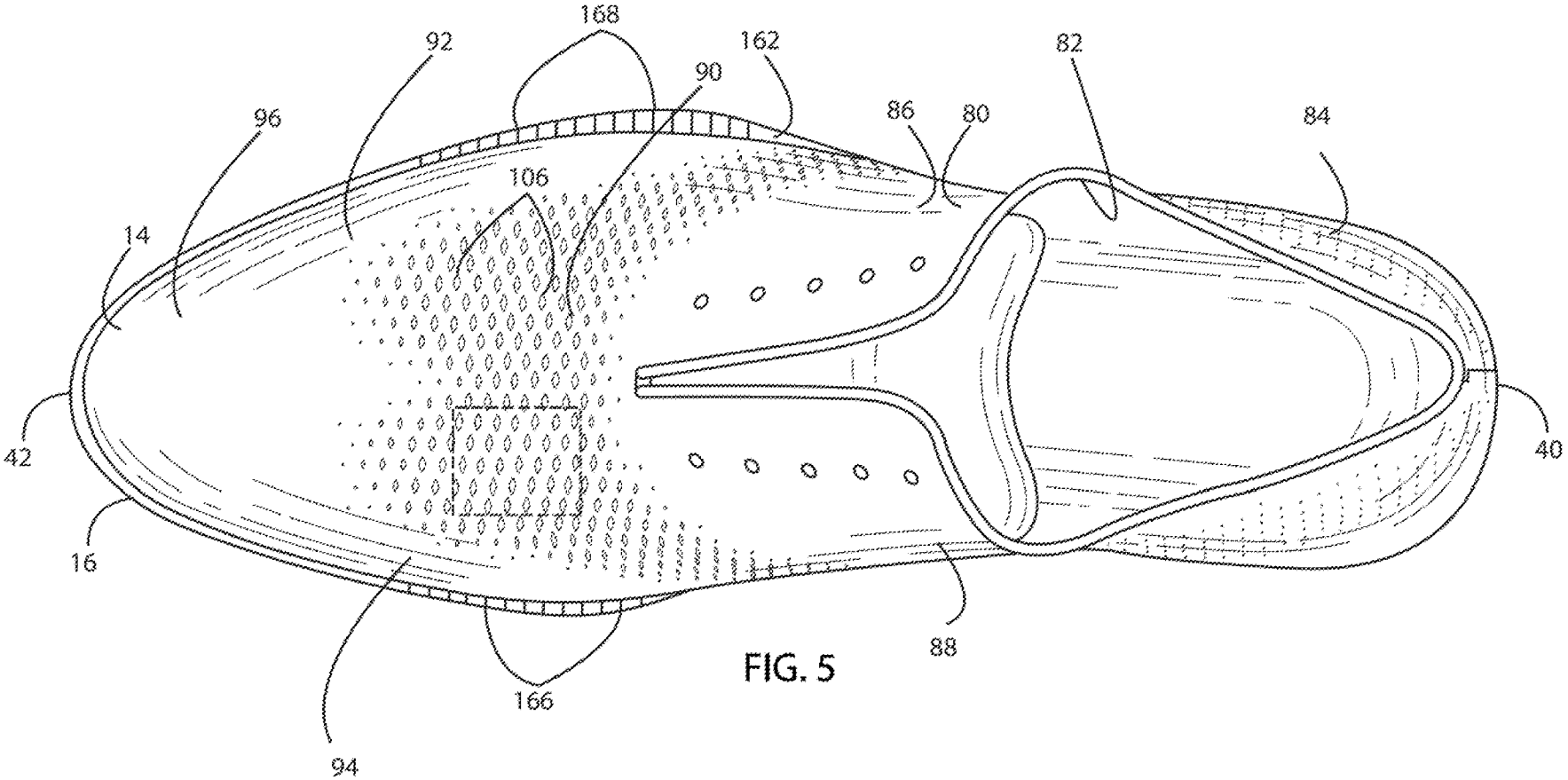
FIG. 5 is a top plan view of the shoe shown in FIG. 1, showing an outer layer of the upper.

Referring to FIG. 4, the sole 12 includes a first plurality of flex grooves 170, a second plurality of flex grooves 172, a third plurality of flex grooves 174, and a longitudinal flex groove 176 in the sole bottom surface 34. In an embodiment of the present invention in which the sole 12 is leather, the various flex grooves can be formed in the sole bottom surface 34 by using a heated press to apply pressure to the sole bottom surface. The first plurality of flex grooves 170 extend transversely from the sole medial side surface 38 toward the sole lateral side surface 36. At least some of the flex grooves of the first plurality of flex grooves 170 are in the sole medial ball region 54. The second plurality of flex grooves 172 extend transversely from the sole lateral side surface 36 toward the sole medial side surface 38. At least some of the flex grooves of the second plurality of flex grooves 172 are in the sole lateral ball region 56. Each flex groove of the first plurality of flex grooves 170 is aligned with and transversely spaced from a corresponding flex groove of the second plurality of flex grooves 172. The third plurality of flex grooves 174 extend transversely between the sole lateral side surface 36 and the sole medial side surface 38. Each of the flex grooves of the third plurality of flex grooves 174 are transversely spaced from the sole medial side surface 38 and transversely spaced from the sole lateral side surface 36. One of the flex grooves of the first plurality of flex grooves 170 and one of the flex grooves of the second plurality of flex grooves 172 is longitudinally between each adjacent pair of the third plurality of flex grooves 174. The longitudinal flex groove 176 extends longitudinally between the sole heel end surface 40 and the sole toe end surface 42. Each flex groove of the first plurality of flex grooves 170 and each flex groove of the second plurality of flex grooves 172 are transversely spaced from the longitudinal flex groove 176. The longitudinal flex groove 176 intersects each flex groove of the third plurality of flex grooves.

As shown in FIGS. 2 and 3, at least some of the welt slits of the first plurality of welt slits 166 are adjacent at least some of the flex grooves of the first plurality of flex grooves 170 and at least some of the welt slits of the second plurality of welt slits 168 are adjacent at least some of the flex grooves of the second plurality of flex grooves 172. Additionally, at least one of the slits of the first plurality of welt slits 166 is aligned with a corresponding one of the first plurality of flex grooves 170. Collectively, the first plurality of welt slits 166, the second plurality of welt slits 168, the first plurality of flex grooves 170, and the second plurality of flex grooves 172 increase the flexibility of the shoe 10 in the upper metatarsal region 64 and the sole metatarsal region 48.

It should be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a sole comprising a sole bottom surface, a sole lateral side surface, a sole medial side surface, a sole heel end surface, and a sole toe end surface, the sole bottom surface extending transversely from the sole lateral side surface to the sole medial side surface, the sole lateral side surface and the sole medial side surface extending upwardly from the sole bottom surface, the sole extending longitudinally from the sole heel end surface to the sole toe end surface, the sole including a sole heel region, a sole midfoot region, a sole metatarsal region, a sole ball region, and a sole toe region, the sole heel region extending longitudinally from the sole heel end surface to the sole midfoot region, the sole midfoot region extending longitudinally from the sole heel region to the sole metatarsal region, the sole metatarsal region extending from the sole midfoot region to the sole ball region, the sole ball region extending longitudinally from the sole metatarsal region to the sole toe region, and the sole toe region extending longitudinally from the sole ball region to the sole toe end surface, the sole ball region including a sole medial ball region and a sole lateral ball region;

an upper operatively secured to the sole, the upper comprising an upper heel region, an upper lateral midfoot region, an upper medial midfoot region, an upper metatarsal region, an upper lateral ball region, an upper medial ball region, and an upper toe region, the upper metatarsal region including an upper lateral metatarsal region and an upper medial metatarsal region, the upper having an upper lateral side region and an upper medial side region, the upper lateral side region including the upper lateral midfoot region, the upper lateral metatarsal region and the upper lateral ball region, the upper medial side region including the upper medial midfoot region, the upper medial metatarsal region and the upper medial ball region; and a welt;

the sole and the upper collectively defining a seam, the seam having a seam heel region, a seam lateral midfoot region, a seam lateral metatarsal region, a seam lateral ball region, a seam toe region, a seam medial ball region, a seam medial metatarsal region, and a seam medial midfoot region, the seam heel region extending from the seam medial midfoot region to the seam lateral midfoot region, the seam lateral midfoot region extending from the seam heel region to the seam lateral metatarsal region, the seam lateral metatarsal region extending from the seam midfoot region to the seam lateral ball region, the seam lateral ball region extending from the seam lateral metatarsal region to the a seam toe region, the seam toe region extending from the seam lateral ball region to the seam medial ball region, the seam medial ball region extending from the seam toe region to the seam medial metatarsal region, the seam medial metatarsal region extending from the seam medial ball region to the seam medial midfoot region, and the seam medial midfoot region extending from the seam medial metatarsal region to the seam heel region;

the welt comprising at least one piece separate from the sole and separate from the upper, the welt being secured to at least one of the sole and the upper, the welt covering at least part of the seam lateral side region and at least part of the seam medial side region;

the sole including a first plurality of flex grooves in the sole bottom surface, the first plurality of flex grooves extending transversely from the sole medial side surface toward the sole lateral side surface;

the welt including a first plurality of welt slits, at least some of the welt slits of the first plurality of welt slits being adjacent at least some of the flex grooves of the first plurality of flex grooves.

2. A shoe as set forth in claim 1 wherein each of at least some of the slits of the first plurality of welt slits is aligned with a corresponding one of the flex grooves of the first plurality of flex grooves.

3. A shoe as set forth in claim 1 wherein the sole further includes a second plurality of flex grooves in the sole bottom surface and the welt further includes a second plurality of welt slits, the second plurality of flex grooves extending transversely from the sole lateral side surface toward the sole medial side surface, at least some of the slits of the second plurality of welt slits being adjacent at least some of the flex grooves of the second plurality of flex grooves.

4. A shoe as set forth in claim 3 wherein at least some of flex grooves of the first plurality of flex grooves are in the sole medial ball region and at least some of the flex grooves of the second plurality of flex grooves are in the sole lateral ball region.

5. A shoe as set forth in claim 4 wherein the sole further includes a third plurality of flex grooves in the sole bottom surface, the third plurality of flex grooves extending transversely between the sole lateral side surface and the sole medial side surface, each of the flex grooves of the third plurality of flex grooves being transversely spaced from the sole medial side surface and transversely spaced from the sole lateral side surface.

6. A shoe as set forth in claim 5 wherein each flex groove of the first plurality of flex grooves is aligned with and transversely spaced from a corresponding flex groove of the second plurality of flex grooves.

7. A shoe as set forth in claim 6 wherein one of the flex grooves of the first plurality of flex grooves and one of the flex grooves of the second plurality of flex grooves is longitudinally between each adjacent pair of the third plurality of flex grooves.

8. A shoe as set forth in claim 7 wherein the sole further includes a longitudinal flex groove in the sole bottom surface, the longitudinal flex groove extending longitudinally between the sole heel end surface and the sole toe end surface.

9. A shoe as set forth in claim 8 wherein each flex groove of the first plurality of flex grooves is transversely spaced from the longitudinal flex groove, and wherein each flex groove of the second plurality of sole flex grooves is transversely spaced from the longitudinal flex groove.

10. A shoe as set forth in claim 9 wherein the longitudinal flex groove intersects each flex groove of the third plurality of flex grooves.

11. A shoe as set forth in claim 1 wherein the welt constitutes a single, one-piece member.

12. A shoe comprising:

a sole comprising a sole bottom surface, a sole lateral side surface, a sole medial side surface, a sole heel end surface, and a sole toe end surface, the sole bottom surface extending transversely from the sole lateral side surface to the sole medial side surface, the sole lateral side surface and the sole medial side surface extending upwardly from the sole bottom surface, the sole extending longitudinally from the sole heel end surface to the sole toe end surface, the sole including a sole heel region, a sole midfoot region, a sole metatarsal region, a sole ball region, and a sole toe region, the sole heel region extending longitudinally from the sole heel end surface to the sole midfoot region, the sole midfoot region extending longitudinally from the sole heel region to the sole metatarsal region, the sole metatarsal region extending from the sole midfoot region to the sole ball region, the sole ball region extending longitudinally from the sole metatarsal region to the sole toe region, and the sole toe region extending longitudinally from the sole ball region to the sole toe end surface, the sole ball region including a sole medial ball region and a sole lateral ball region;

an upper operatively secured to the sole, the upper comprising an upper heel region, an upper lateral midfoot region, an upper medial midfoot region, an upper metatarsal region, an upper lateral ball region, an upper medial ball region, and an upper toe region, the upper metatarsal region including an upper lateral metatarsal region and an upper medial metatarsal region, the upper having an upper lateral side region and an upper medial side region, the upper lateral side region including the upper lateral midfoot region, the upper lateral metatarsal region and the upper lateral ball region, the upper medial side region including the upper medial midfoot region the upper medial metatarsal region and the upper medial ball region; and a welt;

the sole and the upper collectively defining a seam, the seam having a seam heel region, a seam lateral midfoot region, a seam lateral metatarsal region, a seam lateral ball region, a seam toe region, a seam medial ball region, a seam medial metatarsal region, and a seam medial midfoot region, the seam heel region extending from the seam medial midfoot region to the seam lateral midfoot region, the seam lateral midfoot region extending from the seam heel region to the seam lateral metatarsal region, the seam lateral metatarsal region extending from the seam midfoot region to the seam lateral ball region, the seam lateral ball region extending from the seam lateral metatarsal region to the a seam toe region, the seam toe region extending from the seam lateral ball region to the seam medial ball region, the seam medial ball region extending from the seam toe region to the seam medial metatarsal region, the seam medial metatarsal region extending from the seam medial ball region to the seam medial midfoot region, and the seam medial midfoot region extending from the seam medial metatarsal region to the seam heel region;

the welt having a welt heel region, a welt lateral midfoot region, a welt lateral metatarsal region, a welt lateral ball region, a welt toe region, a welt medial ball region, a welt medial metatarsal region, and a welt medial midfoot region, the welt heel region extending from the welt medial midfoot region to the welt lateral midfoot region and covering the seam heel region, the welt lateral midfoot region extending from the welt heel region to the welt lateral metatarsal region and covering the seam lateral midfoot region, the welt lateral metatarsal region extending from the welt lateral midfoot region to the welt lateral ball region and covering the seam lateral metatarsal region, the welt lateral ball region extending from the welt lateral metatarsal region to the welt toe region and covering the seam lateral ball region, the welt toe region extending from the welt lateral ball region to the welt medial ball region and covering the seam toe region, the welt medial ball region extending from the welt toe region to the welt medial metatarsal region and covering the seam medial ball region, the welt medial metatarsal region extending from the welt medial ball region to the welt medial midfoot region and covering the seam medial metatarsal region, and the welt medial midfoot region extending from the welt medial metatarsal region to the welt heel region and covering the seam medial midfoot region, the welt including a welt top surface, a welt bottom surface, a first plurality of welt slits extending from the welt top surface toward the welt bottom surface, and a second plurality of welt slits extending from the welt top surface toward the welt bottom surface, at least some of the welt slits of the first plurality of welt slits being in the welt medial ball region, at least some of the welt slits of the second plurality of welt slits being in the welt lateral ball region.

13. A shoe as set forth in claim 12 wherein the welt heel region is devoid of welt slits.

14. A shoe as set forth in claim 12 wherein the welt lateral midfoot region and the welt medial midfoot region are devoid of welt slits.

15. A shoe as set forth in claim 12 wherein the welt toe region is devoid of welt slits.

16. A shoe comprising:

a sole comprising a sole bottom surface, a sole lateral side surface, a sole medial side surface, a sole heel end surface, and a sole toe end surface, the sole bottom surface extending transversely from the sole lateral side surface to the sole medial side surface, the sole lateral side surface and the sole medial side surface extending upwardly from the sole bottom surface, the sole extending longitudinally from the sole heel end surface to the sole toe end surface, the sole including a sole heel region, a sole midfoot region, a sole metatarsal region, a sole ball region, and a sole toe region, the sole heel region extending longitudinally from the sole heel end surface to the sole midfoot region, the sole midfoot region extending longitudinally from the sole heel region to the sole metatarsal region, the sole metatarsal region extending from the sole midfoot region to the sole ball region, the sole ball region extending longitudinally from the sole metatarsal region to the sole toe region, and the sole toe region extending longitudinally from the sole ball region to the sole toe end surface, the sole ball region including a sole medial ball region and a sole lateral ball region; and an upper operatively secured to the sole, the upper comprising an upper outer layer, the upper outer layer comprising an outer layer heel region, an outer layer lateral midfoot region, an outer layer medial midfoot region, an outer layer metatarsal region, an outer layer lateral ball region, an outer layer medial ball region, and an outer layer toe region, the outer layer metatarsal region including an outer layer lateral metatarsal region and an outer layer medial metatarsal region, the outer layer having an outer layer lateral side region and an outer layer medial side region, the outer layer lateral side region including the outer layer lateral midfoot region, the outer layer lateral metatarsal region, and the outer layer lateral ball region, the outer layer medial side region including the outer layer medial midfoot region, the outer layer medial metatarsal region, and the outer layer medial ball region, the outer layer being of leather, the outer layer including a plurality of through-perforations, each of the perforations of the plurality of perforations having a perforation length and a perforation width, the perforation width extending in a longitudinal direction of the shoe, the longitudinal direction of the shoe being a direction extending generally toward the sole heel end surface and away from the sole toe end surface, the perforation length extending in a direction substantially perpendicular to the longitudinal direction of the shoe, the perforation length being greater than the perforation width, wherein the plurality of perforations are in the outer layer metatarsal region.

17. A shoe as set forth in claim 16 wherein the perforation length is at least twice as great as the perforation width.

18. A shoe as set forth in claim 17 wherein each one of the perforations of the plurality of perforations is spaced a distance from another one of the plurality of perforations, the distance being less than twice the perforation length of said another one of the plurality of perforations.

19. A shoe as set forth in claim 17 wherein each one of the perforations of the plurality of perforations is spaced a distance from another one of the plurality of perforations, the distance being less than the perforation length of said another one of the plurality of perforations.

20. A shoe as set forth in claim 16 wherein each one of the perforations of the plurality of perforations is spaced a distance from another one of the plurality of perforations, the distance being less than twice the perforation length of said another one of the plurality of perforations.

21. A shoe as set forth in claim 16 wherein each one of the perforations of the plurality of perforations is spaced a distance from another one of the plurality of perforations, the distance being less than the perforation length of said another one of the plurality of perforations.

22. A shoe as set forth in claim 16 wherein the upper further comprises an upper inner layer, the upper inner layer comprising an inner layer metatarsal region, an inner layer lateral ball region, an inner layer medial ball region, and an inner layer toe region, the inner layer metatarsal region including an inner layer lateral metatarsal region and an inner layer medial metatarsal region, the inner layer having an inner layer lateral side region and an inner layer medial side region, the upper outer layer overlying the upper inner layer such that the upper inner layer is visible through at least some of the plurality of perforations of the upper outer layer, the upper inner layer being of a textile material.

23. A shoe as set forth in claim 22 wherein the upper inner layer is of a moisture wicking fabric.

24. A shoe as set forth in claim 23 wherein the moisture wicking fabric comprises spandex.

25. A shoe comprising:

a sole comprising a sole bottom surface, a sole lateral side surface, a sole medial side surface, a sole heel end surface, and a sole toe end surface, the sole bottom surface extending transversely from the sole lateral side surface to the sole medial side surface, the sole lateral side surface and the sole medial side surface extending upwardly from the sole bottom surface, the sole extending longitudinally from the sole heel end surface to the sole toe end surface, the sole including a sole heel region, a sole midfoot region, a sole metatarsal region, a sole ball region, and a sole toe region, the sole heel region extending longitudinally from the sole heel end surface to the sole midfoot region, the sole midfoot region extending longitudinally from the sole heel region to the sole metatarsal region, the sole metatarsal region extending from the sole midfoot region to the sole ball region, the sole ball region extending longitudinally from the sole metatarsal region to the sole toe region, and the sole toe region extending longitudinally from the sole ball region to the sole toe end surface, the sole ball region including a sole medial ball region and a sole lateral ball region, the sole including a first plurality of flex grooves in the sole bottom surface, the first plurality of flex grooves extending transversely from the sole medial side surface toward the sole lateral side surface; and an upper operatively secured to the sole, the upper comprising an upper outer layer, the upper outer layer comprising an outer layer heel region, an outer layer lateral midfoot region, an outer layer medial midfoot region, an outer layer metatarsal region, an outer layer lateral ball region, an outer layer medial ball region, and an outer layer toe region, the outer layer metatarsal region including an outer layer lateral metatarsal region and an outer layer medial metatarsal region, the outer layer having an outer layer lateral side region and an outer layer medial side region, the outer layer lateral side region including the outer layer lateral midfoot region, the outer layer lateral metatarsal region, and the outer layer lateral ball region, the outer layer medial side region including the outer layer medial midfoot region, the outer layer medial metatarsal region, and the outer layer medial ball region, the outer layer being of leather, the outer layer including a plurality of through-perforations, each of the perforations of the plurality of perforations having a perforation length and a perforation width, the perforation width extending in a longitudinal direction of the shoe, the longitudinal direction of the shoe being a direction extending generally toward the sole heel end surface and away from the sole toe end surface, the perforation length extending in a direction substantially perpendicular to the longitudinal direction of the shoe, the perforation length being greater than the perforation width, wherein the plurality of perforations are in the outer layer metatarsal region.

26. A shoe as set forth in claim 25 wherein the plurality of perforations in the outer layer metatarsal region comprises at least 75 perforations.

27. A shoe as set forth in claim 26 wherein the plurality of perforations in the outer layer metatarsal region are in a pattern comprising a plurality of rows and a plurality of columns.

28. A shoe as set forth in claim 25 wherein the plurality of perforations in the outer layer metatarsal region comprises at least 100 perforations.

* * * * *